US006943780B1

(12) United States Patent
Van Dijk

(10) Patent No.: US 6,943,780 B1
(45) Date of Patent: Sep. 13, 2005

(54) DRIVING A MATRIX DISPLAY PANEL

(75) Inventor: Roy Van Dijk, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 700 days.

(21) Appl. No.: 09/426,696

(22) Filed: Oct. 25, 1999

(30) Foreign Application Priority Data

Oct. 27, 1998 (EP) ..... 98203623

(51) Int. Cl.[7] ..... G09G 3/00
(52) U.S. Cl. ..... 345/204; 345/60; 345/100
(58) Field of Search ..... 345/41, 58, 60–64, 345/100, 204, 87–99, 101–103; 365/116; 315/169.1, 169.3, 169.4

(56) References Cited

U.S. PATENT DOCUMENTS 4,896,149 A 1/1990 Buzak et al. ..... 365/794
5,625,373 A * 4/1997 Johnson ..... 345/58
5,661,501 A 8/1997 Tanamachi ..... 345/60
5,818,411 A * 10/1998 Sakamoto et al. ..... 345/99
5,841,411 A * 11/1998 Francis ..... 345/58
6,023,257 A * 2/2000 Koyama ..... 345/58
6,049,319 A * 4/2000 Sakamoto et al. ..... 345/94

FOREIGN PATENT DOCUMENTS

EP 0614166 * 9/1994
EP 0853307 * 7/1998

* cited by examiner

*Primary Examiner*—Lun-Yi Lao

(57) ABSTRACT

In a driver circuit (1) for a matrix display with pixels (Pij) associated with cross points of data electrodes (DEj) and select electrodes (SEi), data signals (DSj) are supplied by the data driver (12) to the data electrodes (Dej) to store data voltages in pixels (Pij) associated with a selected one of the select electrodes (SEi). A bias circuit (13) increases a bias current (IB) of the data driver (12) only when an edge of at least one of the data signals (DSj) occurs or is expected to occur. The bias current (IB) is selected to be very small if no edge of the data signal (DSj) occurs or is expected to occur, and the power dissipation in the data driver (12) will be lowered. If no edge occurs or is expected to occur, the bias current (IB) has a low value during the whole select time (also referred to as address time) of a row (Ri) of pixels (Pij). If an edge occurs, there are several possibilities to allow the required short duration of the data setup time: the bias current (IB) has a high value during the whole select time of a row (Ri), or only during the data setup period.

6 Claims, 7 Drawing Sheets

DRIVING A MATRIX DISPLAY PANEL

BACKGROUND OF THE INVENTION

The invention relates to a driver circuit for a matrix display panel. The invention also relates to a display apparatus comprising a matrix display panel.

U.S. Pat. No. 4,896,149 discloses a matrix display panel having a display surface comprising a pattern formed by a rectangular planar array of nominally identical display elements which are mutually spaced apart. Each display element in the array represents the overlapping portions of column or data electrodes arranged in vertical columns, and narrow channels arranged in horizontal rows. The data electrodes are deposited on a major surface of a first electrically non-conductive, optically transparent substrate, and the channels are inscribed in a major surface of a second electrically non-conductive, optically transparent substrate. Each channel is filled with an ionizable gas. Electro-optic material (for example, a nematic liquid crystal) and a thin layer of dielectric material are sandwiched between the two substrates. The dielectric layer functions as a barrier between the ionizable gas and the layer of liquid crystal material. Each display element can be modeled as a capacitor whose top plate represents one of the data electrodes and whose bottom plate represents the free surface of the layer of dielectric material. Each channel comprises a parallel arrangement of a reference electrode and a row electrode. The reference electrodes are connected to a common electric reference potential.

A data driver supplies data signals via output amplifiers as data voltages in parallel with the data electrodes. When a data strobe or select driver supplies a select pulse with sufficient amplitude to the row or select electrode, the gas in the channel assumes an ionized state and becomes conductive (plasma). In this way, a row of display elements associated with this channel is selected. This means that the capacitors are charged with the data voltages. Upon completion of the storage of the data signals, the select driver terminates the voltage pulse and the plasma starts extinguishing. When the plasma has been extinguished, the capacitors are disconnected as the free surface of the layer of dielectric material is floating again. The charge on the capacitors will be stored until the plasma in the channel becomes conductive again. The select electrodes are selected one by one until the entire display surface is completely addressed to store and display an image field of data.

The timing involved in storing a line of data in a row of display elements is explained in the following description. First, the plasma has to be formed after the select electrode receives a select pulse. The plasma formation time may be partly eliminated as a factor in the timing by initiating the select pulse in advance during a preceding line. The data voltages must be present before the plasma starts decaying too much. The data setup time represents the time during which the data driver slews between the data values of two adjacent lines of data. Next, it takes some time for a display element to acquire the presented data voltage. This data capture time depends on the mobility of the plasma ions. The plasma decay time represents the time during which the plasma in the channel returns to a de-ionized state upon removal of the select pulse. The conductivity of the plasma has to decrease to such a value that the crosstalk is sufficiently low when the subsequent data signals are presented to the next row of display elements. The time required to address a row of display elements equals at least the sum of the data setup time, the data capture time, and the plasma decay time.

If high-resolution display information with a high line frequency has to be displayed on such a plasma-addressed liquid crystal (PALC) display, the data setup time, the data capture time, and the plasma decay time have to be minimized. In a practical situation, wherein a line of data has to be stored in 12 $\mu$s, a data setup time of 1 to 2 $\mu$s is required. Known data drivers show a high dissipation to allow such a short data setup time.

SUMMARY OF THE INVENTION

It is, inter alia, an object of the invention to decrease the power dissipation in the data drivers.

To this end, a first aspect of the invention provides a driver circuit for a matrix display panel with select electrodes and data electrodes, the driver circuit comprising a select driver for selecting the select electrodes and a data driver for supplying data signals to display elements associated with a selected one of the select electrodes via the data electrodes. The driver circuit further comprises bias circuitry coupled to the data driver for increasing a bias current of the data driver upon the occurrence of an edge of at least one of the data signals. A second aspect of the invention provides a display apparatus comprising a matrix display panel with select electrodes and data electrodes, and a driver circuit comprising a select driver for selecting the select electrodes and a data driver for supplying data signals to display elements associated with a selected one of the select electrodes via the data electrodes. The driver circuit further comprises bias circuitry coupled to the data driver for increasing a bias current of the data driver upon the occurrence of an edge of at least one of the data signals.

In a driver circuit for a matrix display in accordance with a primary aspect of the invention, a bias circuit increases a bias current of the data driver only when an edge of at least one of the data signals occurs or is expected to occur. In this way, the bias current can be selected to be very small if no edge of the data signal occurs or is expected to occur, and the power dissipation in the data driver will be lowered. If no edge occurs or is expected to occur, the bias current has a low value during the whole select time (also referred to as address time) of a row. If an edge occurs, there are several possibilities of realizing the required short duration of the data setup time: the bias current has a high value during the whole select time of a row, or, preferably, only during the data setup period. A significant reduction of power dissipation will be reached already if the bias current has a small value during at least part of the period outside the data setup period. The short duration of the data setup time may be reached also if the bias current has a high value during part of the data setup time only.

In an embodiment of the invention, the bias circuit comprises a detection circuit for detecting whether a data edge occurs in a signal corresponding to one of the data signals. For example, the detection circuit may receive the data from a serial-to-parallel converter which receives serial video data to supply parallel data signals to the respective data electrodes via output stages. The detection circuit may also receive the data signals as supplied to the data electrodes. A bias control circuit supplies a bias control signal to the data driver in response to the detected edge in the data signal for increasing the bias current. The bias current may be increased for a fixed time, or the bias current may be increased until an end of the data signal edge has been detected. The fixed time may be the whole select time or part of the select time.

In another embodiment of the invention, the bias control signal controls the bias current of all the output stages of the driver circuit. In this way, if a data edge has been detected in a single data signal associated with one of the data electrodes, all the output stages increase their bias current. Only one detector is required. A drawback is that it may happen that no data edge occurs in the monitored data signal, although data edges may occur on unmonitored data electrodes. In a more practical setup, the detection circuit comprises a plurality of detectors, each detector monitoring one data signal of a subset of the data signals. If one of the detectors detects a data edge, the bias current of all output amplifiers is increased. In this way, the number of detectors is smaller than the number of data signals or the number of data electrodes, while there is a small chance for usual video signals that no edge occurs on the monitored data electrodes, although a data edge occurs on one of the unmonitored data electrodes. Thus, in a certain row, the bias current will be increased only if at least one data edge has been detected.

In yet another embodiment of the invention, a detection circuit is associated with each data signal or data electrode. The bias current of a certain output stage supplying one of the data signals to the associated one of the data electrodes is increased when the detection circuit associated with this data signal or with this data electrode detects a data edge in this data signal. This has the advantage that only the bias current of those output stages at which a data edge has been detected will be increased, which decreases the power dissipation even further.

In still another embodiment of the invention, a timing control circuit controls the periods of time during which the bias current is increased. The timing control circuit controls the instants at which the data signals have to be supplied to the data electrodes after the display elements associated with a select electrode have been selected. In the preferred situation, in which the data signals are supplied in parallel to the data electrodes, the timing control circuit knows at which instant the data edges start and is therefore able to increase the bias current of all output stages in relation to this instant. An advantage of this approach is that no detection circuits are needed at all. A drawback is that the bias current will be increased during fixed periods of time when a data edge is expected to occur, irrespective of whether the data edge occurs or not. In the situation in which the data signals would be serially supplied to the data electrodes, the timing control circuit again knows when a data edge may occur on which data electrode. Now, the timing control circuit successively increases the bias current of the output stage expected to supply a data edge. In both situations, it is advantageous to start the increase of the bias current shortly before the instant when the data edge may occur, such that the output amplifier immediately responds with full speed to the data edge when received.

These and other aspects of the invention are apparent from and will be elucidated, by way of non-limitative example, with reference to the embodiments described hereinafter.

DESCRIPTION OF THE PREFERRED EMBODIMENTS

Figure 1:
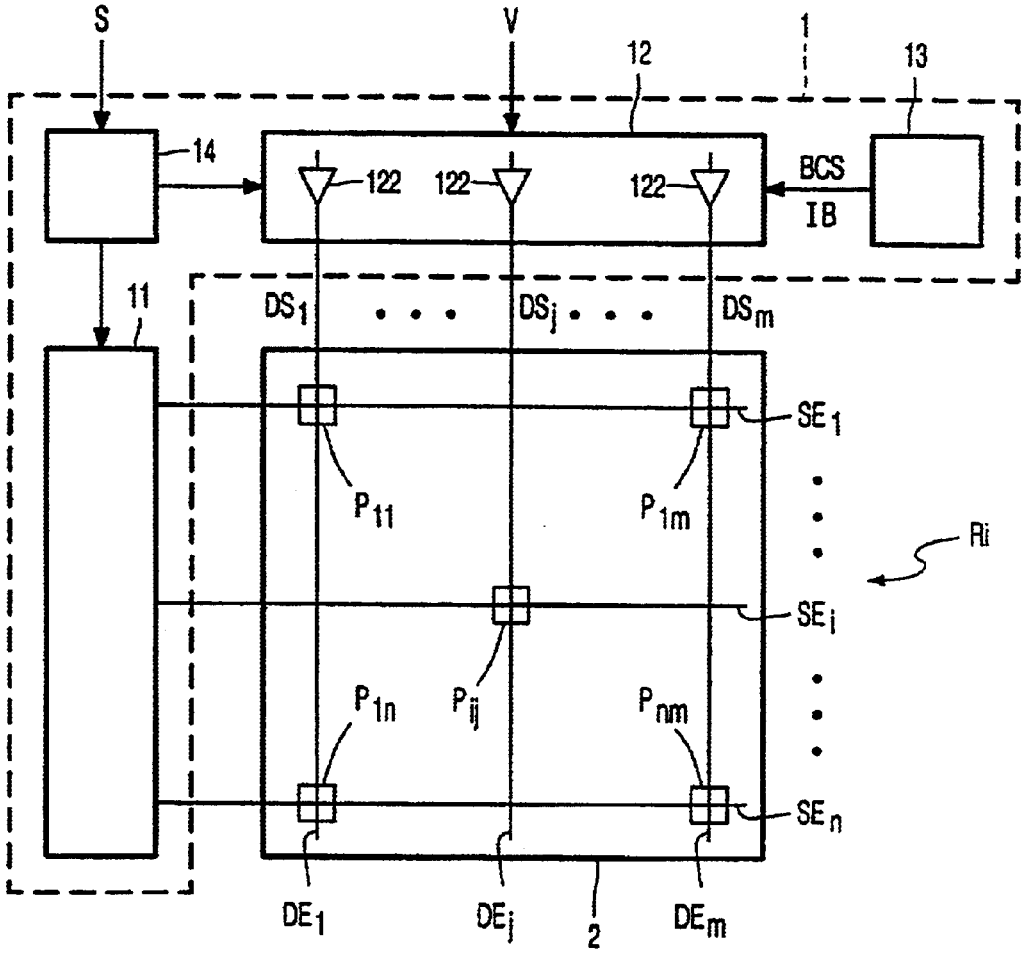
FIG. 1 shows a basic block diagram of a matrix display panel and a driver circuit for driving the matrix display panel.

FIG. 1 shows a basic block diagram of a matrix display panel 2 and a driver circuit 1 for driving the matrix display panel 2. The matrix display panel 2 comprises a matrix of n★m display elements Pij (P11 to Pnm). Each display element or pixel Pij is coupled between a horizontally extending select electrode SEi and a vertically extending data electrode DEj. A select driver 11 is connected to the n select electrodes SEi (SE1 to SEn) to supply select pulses for successively selecting rows Ri of pixels Pij one by one. A data driver 12 receives a display signal V and supplies data signals DSj (DS1 to DSm) to the selected row Ri of pixels Pij via the m data electrodes DEj (DE1 to DEm). The pixels Pij behave as capacitive loads. The data driver 12 comprises m output stages 122, one for each data electrode DEj, to supply the large charge or discharge currents to the pixels Pij during data edges. Capital letters refer to signals or structures, while small letters i, j, n, and m are intended to be indices referring to rows Ri, columns (the data electrodes DEj), or pixels Pij in the matrix display panel 2.

A timing control circuit 14 controls the timing of the select pulses and the data signals DSj. If the display signal V is a progressive scanned video signal with fields of lines, the rows Ri of pixels Pij are selected one by one to display the lines of the display signal V on corresponding rows of the matrix display panel 2. The data signals DSj corresponding to a particular line of the video signal V are stored in the associated row Ri of pixels Pij once in every field period of the video signal V during a select period wherein the particular row Ri is selected. But if the number of lines in a field of the video signal V is not equal to the number of rows of the matrix display, the same line may be written to more than one row simultaneously or successively, or lines are discarded.

A bias circuit 13 supplies a bias control signal BCS to the data driver 12 to control a bias current IB flowing in the output stages 122 of the data driver 12. The bias control signal BCS may be the bias current IB. The bias current IB should be large enough to allow a high slew rate of the output stages 122, such that the data setup time is sufficiently short. For example, if the capacitance of a column of pixels Pij is 100 pF, and a data edge of 50 volts has to occur in 2 $\mu$s, a charge or discharge current of 2,5 mA has to be supplied. Let it be assumed that a typical integrated MOS output stage 122 requires a bias current IB of about 160 $\mu$A, and that the matrix display panel 2 comprises about 4000 data electrodes DSj (for a resolution of 1280 triplets of 3 colors) driven by 4000 output stages 122. At a power supply voltage of 60 volts, the total dissipation due to this bias current is $4000*60*160*10^{31\ 6}\approx 40$ Watts. For example, the select period of a particular row is 12 $\mu$s, the bias current IB is selected to be 160 $\mu$A during the data setup time of 2 $\mu$s, and 30 $\mu$A during the rest of the select period. Now, the average bias current has been lowered to $2/12*160+10/12*30\approx 52$ $\mu$A. The total dissipation due to this lower average bias current decreases to $4000*60*52*10^{31\ 6}\approx 12{,}5$ watts.

The driver circuit 1 comprises the select driver 11, the data driver 12, the timing control circuit 14 and the bias circuit 13.

Figure 2:
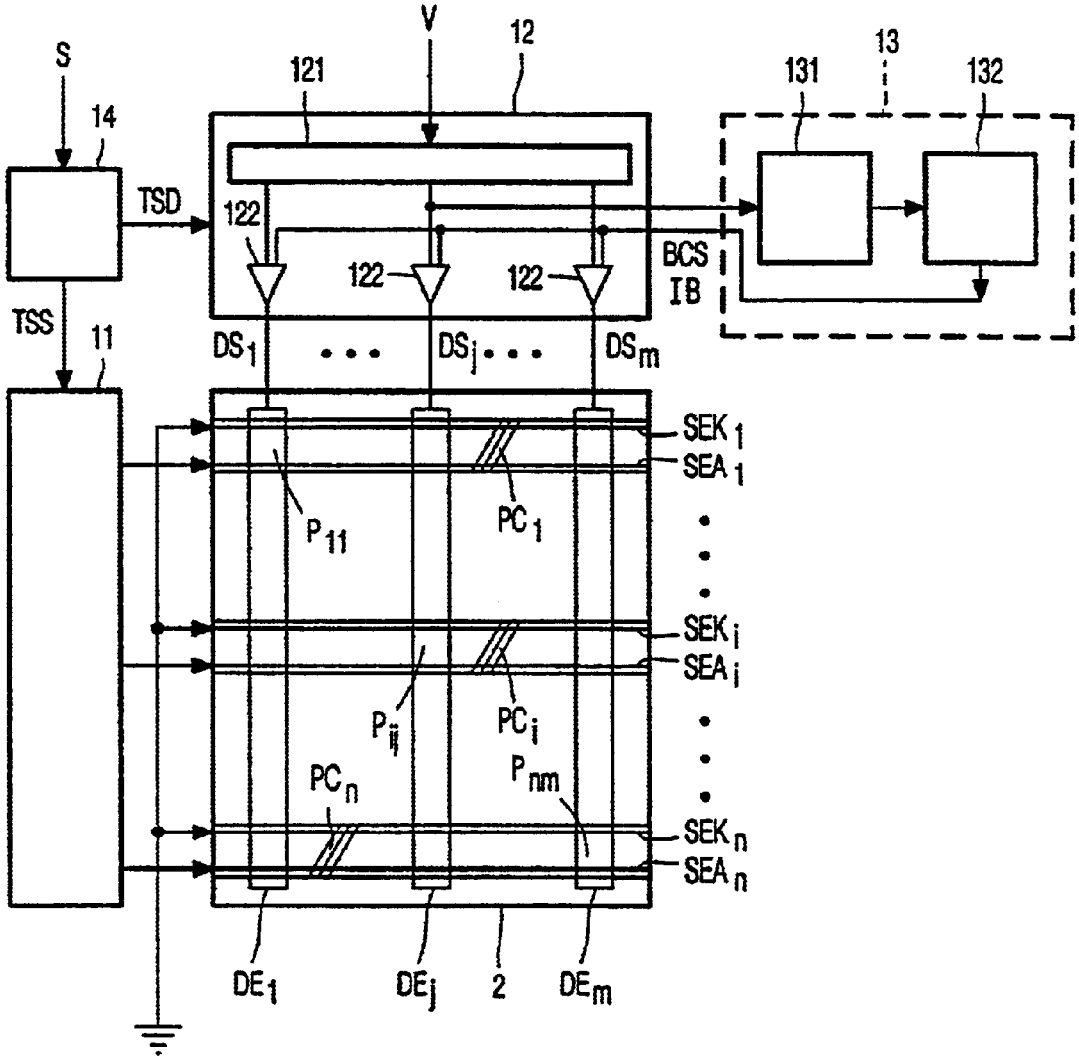
FIG. 2 shows a block diagram of a PALC display, its driving circuits, and an embodiment of the bias circuit in accordance with the invention.

FIG. 2 shows a block diagram of a PALC display, its driving circuits, and an embodiment of the bias circuit in accordance with the invention. Functions with the same references as in FIG. 1 have the same meaning. The matrix display panel 2 comprises n horizontally arranged plasma channels PCi (PC1 to PCn). For the sake of clarity, the plasma channels PCi are partly shaded. Two electrodes are associated with each plasma channel PCi: a select electrode SEAi (SEA1 to SEAn) and a reference electrode SEKi (SEK1 to SEKn), also referred to as anode and cathode, respectively. Data electrodes DEj (DE1 to DEm) extend vertically. The matrix of n*m display elements Pij (P11 to Pnm) is formed by the overlapping regions of the horizontally extending plasma channels PCi and the vertically extending data electrodes DEj. Such a matrix display panel 2 is known from U.S. Pat. No. 4,896,149, which is herein incorporated by reference.

A select driver 11 is connected to the n select electrodes SEAi to supply select pulses for successively selecting rows of pixels Pij one by one. A data driver 12 receives a display signal V to supply data signals DSj (DS1 to DSm) to the selected row of pixels Pij via the m data electrodes DEj (DE1 to DEm). The data driver 12 comprises a conversion circuit 121 receiving the display signal V as serial data to supply parallel data signals in parallel to the output stages 122.

The bias circuit 13 comprises a detection circuit 131 and a bias control circuit 132. The detection circuit 131 is connected to one of the outputs of the conversion circuit 121 to receive one of the parallel data signals. When the detection circuit 131 detects an edge in this signal, the bias control circuit 132 is commanded to increase the bias current IB of all output stages 122. As discussed hereinbefore, an improved reliability of detecting a data edge is obtained when the detection circuit 131 receives a subset of the parallel data signals. The bias control circuit 132 increases the bias current IB of all output stages 122 when an edge is detected in at least one of the monitored parallel data signals.

A timing control circuit 14 receives synchronizing information S to supply timing signals TSD, TSS to the data driver 12 and the select driver 11, respectively, to coordinate the selection of the rows of display elements Pij and the supply of the corresponding data signals DSj. The synchronizing information S indicates the position of lines and fields of the video signal V.

Figures 3A, 3B, 3C, 3D, 3E, 3F:
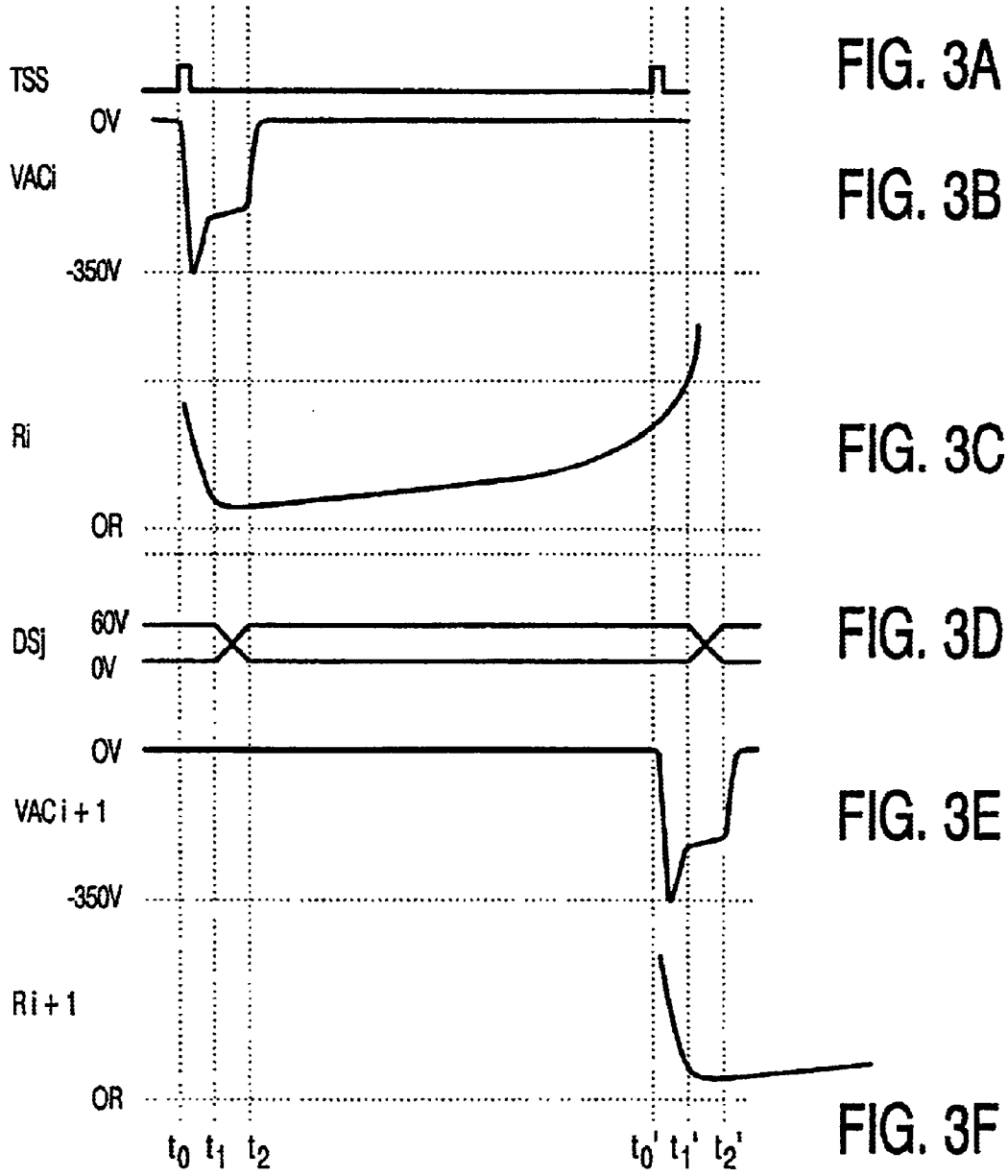
FIGS. 3A to 3F represent time diagrams showing the different phases occurring in a row select period of the PALC display.

FIGS. 3A to 3F represent time diagrams showing the different phases occurring in a row select period of the PALC display. FIG. 3A shows the timing signal TSS supplied to the select driver 11. FIG. 3B shows the select pulse VACi applied between the select electrode SEAi (the anode) and the reference electrode SEKi (the cathode) both associated with the plasma channel PCi. FIG. 3C shows the impedance Ri of the plasma in the plasma channel PCi. FIG. 3D shows a data signal DSj. FIG. 3E shows the select pulse VACi+1 applied between the anode SEAi+1 and cathode SEKi+1 of the succeeding plasma channel PCi+1. FIG. 3F shows the impedance Ri+1 of the plasma in the plasma channel PCi+1.

At the instant t0, the timing signal TSS commands the select driver 11 to supply a select pulse VACi to the select electrodes SEAi and SEKi associated with the plasma channel PCi. As shown in FIG. 3C, the resistance of the ionizable gas starts decreasing until the plasma is formed at instant t1. The period of time from t0 to t1 is the plasma formation time. FIG. 3D shows one of the parallel supplied data signals DSj, the data setup period starts at instant t1 and lasts until instant t2. Next, the select pulse VACi is terminated to allow the plasma associated with row Ri to attain a high impedance. The plasma decay time runs from instant t2 to instant t1'. At the instant t1', the impedance of the plasma channel PCi is high enough to prevent a change of the pixel charge of pixels Pij associated with the plasma channel PCi by more than half a least significant bit from occurring when the data signals DSj for the next row Ri+1 are applied. To be able to store the data signals DSj of the next line of the video signal V in the next row Ri+1 of pixels Pij, the timing signal TSS controls the select driver 11 to supply a select pulse VACi+1 to the select electrodes SEAi+1 and SEKi+1 starting at instant t0'. The timing constraints for the different phases become even more stringent if data inversion is applied. In this case, the data signal DSj is inverted substantially halfway the instants t2 and t2'. Thus, two plasma ignitions and two plasma decay periods have to fit in the period between the instants t1 and t1'. It is thus important to keep all periods as short as possible. The invention envisages obtaining a short data setup time (t1 to t2) without excessive dissipation in the data drivers 12.

Figure 4:
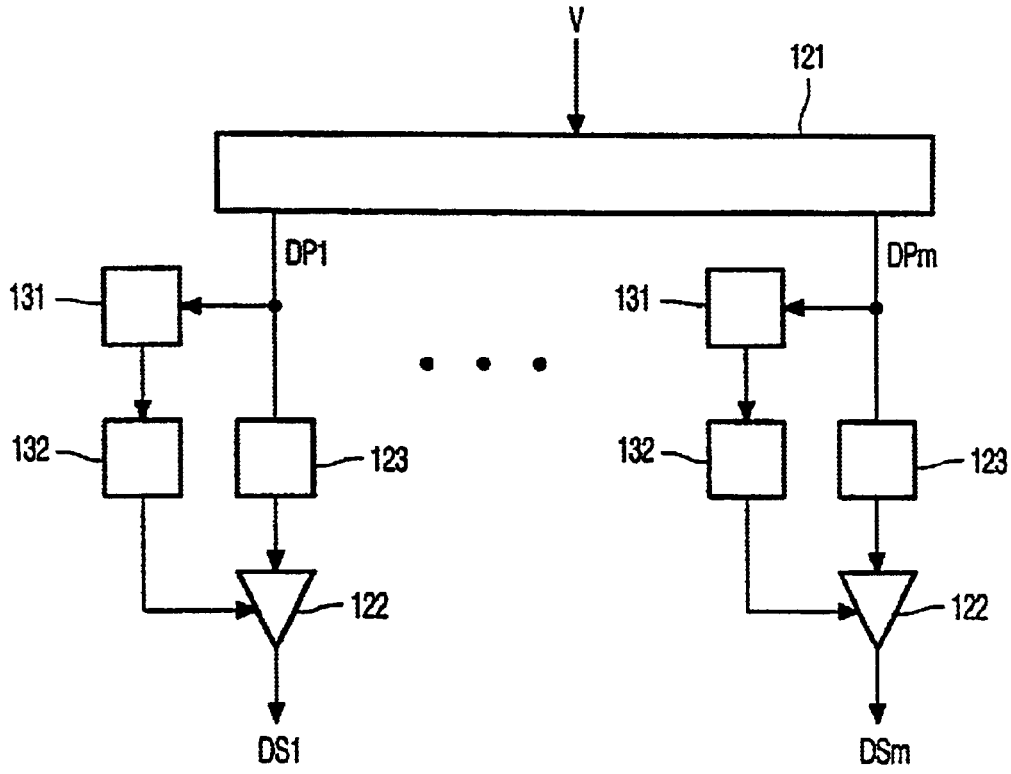
FIG. 4 shows the data driver and an embodiment of the bias circuit in accordance with the invention.

FIG. 4 shows the data driver and an embodiment of the bias circuit in accordance with the invention. The conversion circuit 121 converts the serial data of the video signal V into the parallel data signals DPj (DP1 to DPm) supplied to the output stages 122. The bias circuit 13 comprises a plurality of detection circuits 131 and bias control circuits 132. Each detection circuit 131 commands an associated bias control circuit 132 to increase the bias current of the associated output stage 122 when an edge has been detected in the corresponding parallel data signal DPj. In this way, the bias current of an output stage 122 is increased only when the data signal DSj to be supplied comprises an edge. Optionally, the data driver 12 may comprise delay stages 123 to delay the parallel data signals DPj to allow the bias circuit 13 to increase the bias current of the output stage 122 before the edge of the parallel data signal DPj arrives.

Figure 5:
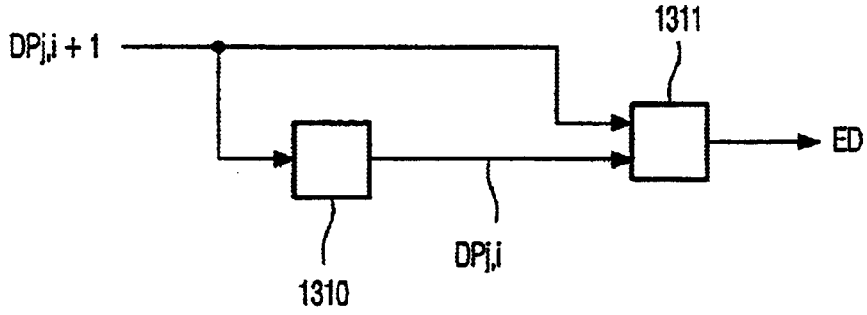
FIG. 5 shows a detailed embodiment of the detection circuit of FIG. 4.

FIG. 5 shows a detailed embodiment of the detection circuit 131 of FIG. 4. The detection circuit 131 comprises a memory element 1310 with an input receiving one of the parallel data signals DPj,i+1 to be supplied to column electrode DEj during the select period of row Ri+1, and an output connected to a first input of a logic XOR 1311 to supply the parallel data signal DPj,i as supplied to column electrode DEj during the select period of row Ri. The logic XOR 1311 has a second input receiving the parallel data signal DPj,i+1 to supply an edge presence signal ED having a high level when the level of the parallel data DPj,i+1 differs from the level of the parallel data DPj,i and thus a data edge occurred. For example, the memory element 1310 may be a D-type flip-flop.

The parallel data signals DPj may be n bit words which are converted into the corresponding analog data signals DSj in A/D converters (not shown) preceding the output amplifiers 122. The detection circuit 133 as shown in FIG. 5 may receive one of the n bits, an OR-ed subset of the n bits (preferably the most significant bits), or the n bits being OR-ed. It is also possible to provide a detection circuit 133 for every bit to be evaluated, and to OR the results. It is also possible to first convert the n-bit word into the analog signal and use a level detector to determine whether the present level of the analog signal has been changed with respect to a stored level of the analog signal occurring during a preceding row Ri.

Figure 6:
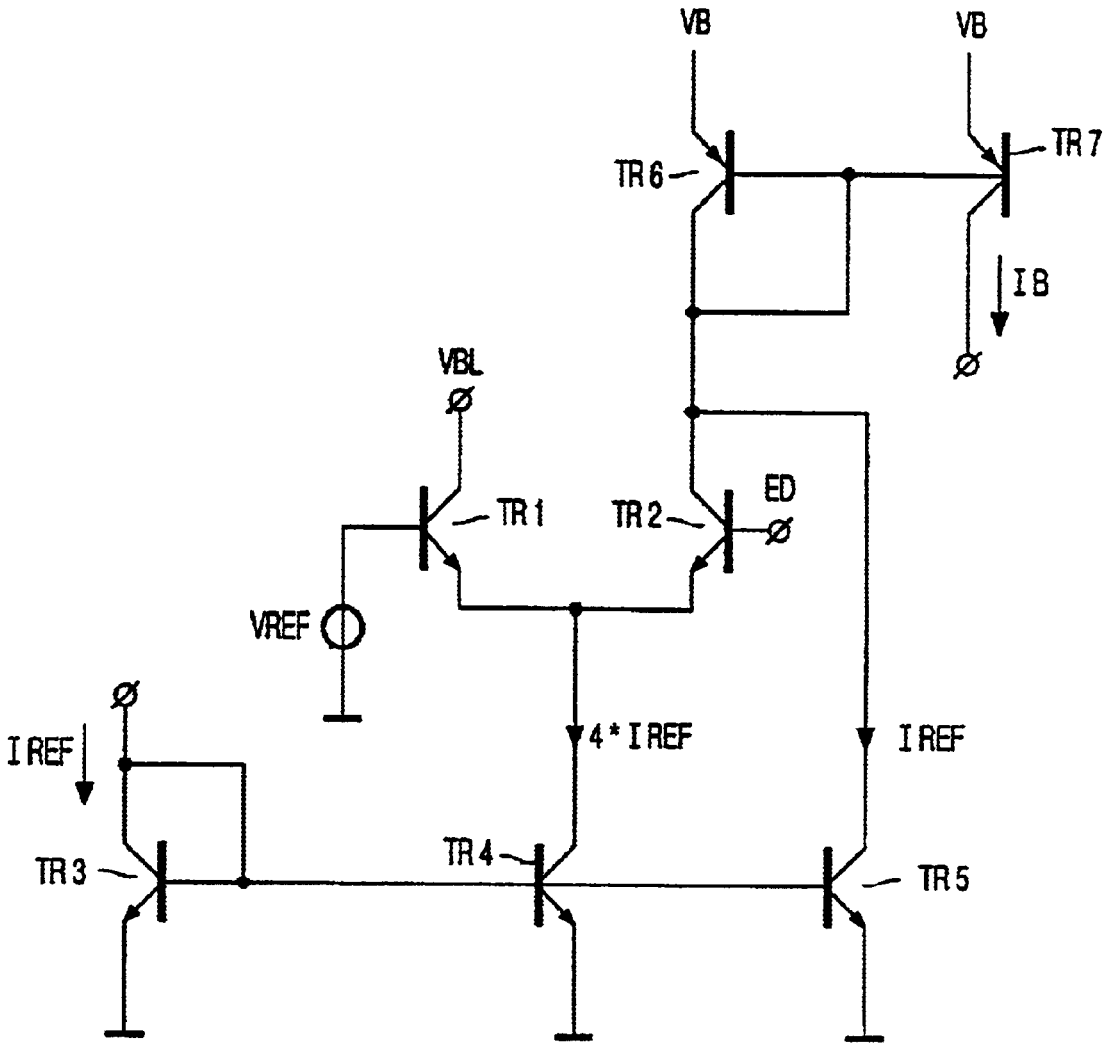
FIG. 6 shows a detailed embodiment of the bias control circuit of FIG. 4.

FIG. 6 shows a detailed embodiment of the bias control circuit 132 of FIG. 4. An npn transistor TR1 has a base connected to a reference voltage VREF, a collector connected to a supply voltage VBL, and an emitter connected to an emitter of an npn transistor TR2. The transistor TR2 has a base to receive the edge presence signal ED, and a collector connected to a collector of an npn transistor TR5. The transistor TR5 has an emitter connected to ground, and a base connected to a base of an npn transistor TR4 and to a base of an npn transistor TR3. The transistor TR3 has an emitter connected to ground, and a collector receiving a reference input current IREF. The base and the collector of the transistor TR3 are interconnected. The transistor TR4 has an emitter connected to ground, and a collector connected to the emitter of the transistor TR1. The collector of the transistor TR2 is also connected to a collector and a base of a pnp transistor TR6 with an emitter connected to the supply voltage VB. A pnp transistor TR7 has a base connected to the base of transistor TR6, an emitter connected to the supply voltage VB, and a collector supplying a bias current IB to the associated output stage 122. The supply voltage VB is selected to allow the large output voltage swing at the output of the output stage 122.

The transistor TR3 operates with each of the transistors TR4 and TR5 as a current mirror. Emitter areas of the transistors TR3, TR4, and TR5 are selected in the ratio 1:4:1, respectively. Consequently, a current with value 4*IREF flows in the collector of the transistor TR4, and the reference current IREF flows in the collector of the transistor TR5. When the edge presence signal ED is low (no edge detected), the transistor TR2 is turned off and the reference current IREF flows in the current mirror composed by the transistors TR6 and TR7. The bias current IB has a value which is substantially equal to the reference current IREF. When the edge presence signal ED is high (an edge has been detected), the transistor TR2 is turned on and a current with a value of 5*IREF flows in the current mirror composed by the transistors TR6 and TR7. Now, the bias current IB has a value which is substantially equal to five times the reference current IREF. In this way, the bias current IB of an output stage 122 of the data driver 12 is increased only if the level of the associated data signal DSj,i+1 for row Ri+1 has been changed with respect to the level of data signal DSj,i for row Ri. The bias current IB is high during a complete selection time of the row Ri if a data edge has been detected. The power dissipation in the data driver decreases as the bias current IB is low for the output stages 122 that need not change the data level. In a practical situation, wherein the video signal V has only a limited high-frequency content, this dissipation reduction is significant. In the situation where a data edge is detected, the dissipation reduction becomes even larger when the bias current IB is increased during part of a select period of a row Ri, only. Preferably, the bias current IB is increased during the edge of the parallel data signal DPj, only. For example, the edge presence signal ED may be adapted to have a high level for a limited time only by adding a one-shot element after the logic XOR. It is also possible to capacitively couple the edge presence signal ED to the input of the bias control circuit 132.

The collector current 4*IREF of the transistor TR4 flows through the transistor TR1 when the edge presence signal ED indicates that no edge is detected. To minimize the dissipation, the power supply voltage VBL has to be selected to be significantly lower than the power supply voltage VB. For example, the power supply voltage VBL is selected to be 5 Volts.

The output stage 122 may have several cascaded amplifier stages with different bias currents. These different bias currents may be generated from the single bias current IB supplied by the embodiment shown in FIG. 6. It is also possible to adapt the embodiment shown in FIG. 6 to supply the different bias currents to the output stage 122. For example, a further pnp transistor may be added with a base connected to the base of the transistor TR7, an emitter connected to the power supply voltage VB, and a collector to supply a further bias current. The ratio between the bias current IB and the further bias current depends on the emitter areas of the transistor TR7 and the further transistor.

Figure 7:
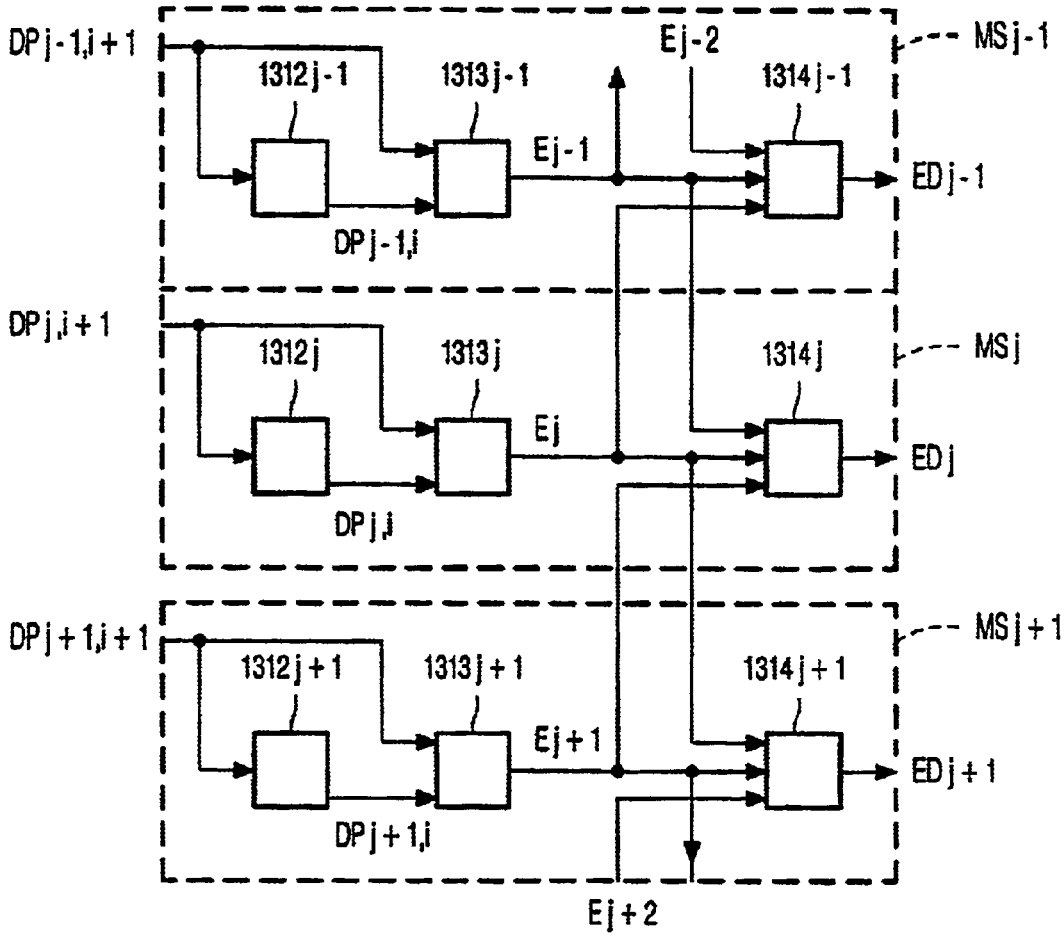
FIG. 7 shows another detailed embodiment of the detection circuit of FIG. 4.

FIG. 7 shows a section of another embodiment of the detection circuit 131 of FIG. 4. If, as for example in PALC displays, the capacitance between adjacent data electrodes DEj is quite large, a change of the level of the data signal DSj on the data electrode DEj produces capacitive currents in the adjacent data electrodes DEj−1 and DEj+1. To maintain the level of the data signals DSj−1 and DSj+1 on these adjacent data electrodes DEj−1 and DEj+1, the corresponding output stages 122 have to supply a compensating current. Thus, in an improved embodiment of the invention, if a data edge is detected in the parallel data signal DPj associated with the data electrode DEj, the bias current IB is increased for the output stages 122 connected to the successive data electrodes DEj−1, DEj and DEj+1.

The section of the embodiment of the detection circuit 131 of FIG. 7 comprises three identical subsections MSj−1, MSj, and MSj+1. Each subsection comprises a memory element 1312j−1, 1312j, 1312j+1, a logic XOR 1313j−1, 1313j, 1313j+1, and a logic OR 1314j−1, 1314j, 1314j+1, respectively, to process the parallel data signals DPj−1, DPj, DPj+1 associated with three subsequent data electrodes DEj−1, DEj, DEj+1, respectively. Each subsection MSj−1, MSj, and MSj+1 is constructed and operates in the same way, the same functions and the corresponding signals are indicated by the same symbols, only the indices differ. Therefore, only the middle subsection MSj is elucidated in detail. The middle subsection MSj comprises the memory element 1312j with an input receiving one of the parallel data signals DPj,i+1 to be supplied to the $j^{th}$ column electrode DEj during the select period of the $i+1^{th}$ row Ri+1, and an output connected to a first input of the logic XOR 1313j to supply the parallel data signal DPj,i as supplied to column electrode DEj during the select period of the $i^{th}$ row Ri. The logic XOR 1313j has a second input receiving the parallel data signal DPj,i+1 to supply an output signal Ej having a high level when the level of the parallel data DPj,i+1 differs from the level of the parallel data DPj,i and thus a data edge occurred. The logic OR 1314j has a first input receiving the output signal Ej−1 of the logic XOR 1313j−1 of the preceding subsection MSj−1, a second input receiving the output signal Ej, a third input receiving the output signal of the logic XOR 1313j+1 of the succeeding subsection MSj+1, and an output to supply the edge presence signal EDj to the bias control circuit 132 connected to the output stage 122 associated with the $j^{th}$ data electrode DEj.

When the parallel data signal DPj on the $j^{th}$ data electrode DEj changes level from the $i^{th}$ to the $(i+1)^{th}$ row, not only the bias current IB of the output amplifier 122 associated with the $j^{th}$ data electrode DEj is increased, but also the bias currents IB of the output amplifiers 122 associated with the adjacent data electrodes DEj−1 and DEj+1 are increased. The dissipation decreases when the bias current IB of the output amplifiers 122 associated with the adjacent data electrodes DEj−1 and DEj+1 is increased less than the bias current IB of the output amplifier 122 associated with the $j^{th}$ data electrode DEj.

In the same way as described with respect to FIG. 5, the parallel data signals DPj may be n-bit words which are converted into the corresponding analog data signals DSj in A/D converters (not shown) preceding the output amplifiers 122. The detection circuit 133 as shown in FIG. 5 may receive one of the n bits, an OR-ed subset of the n bits, or the n bits being OR-ed. It is also possible to provide a detection circuit 133 for every bit to be evaluated, and to OR the results. It is also possible to first convert the n-bit word into the analog signal and use a level detector to determine whether the present level of the analog signal has been changed with respect to a stored level of the analog signal occurring during a preceding row Ri.

Figure 8:
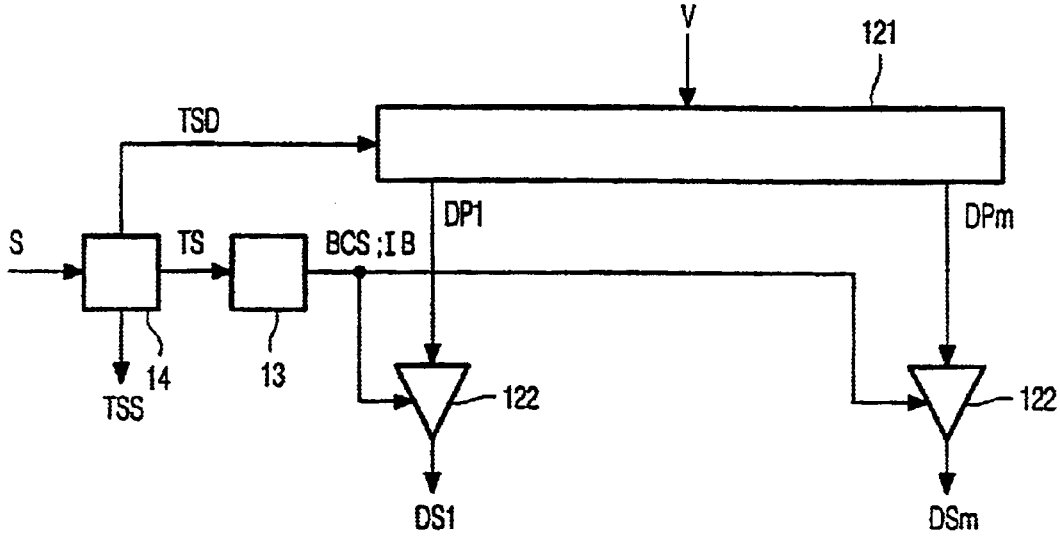
FIG. 8 shows the data driver, another embodiment of the bias circuit, and a timing circuit in accordance with the invention.

FIG. 8 shows the data driver, another embodiment of the bias circuit, and a timing circuit in accordance with the invention. The timing control circuit 14 receives the synchronizing information S to supply the timing signals TSS, TSD, and TS. The timing signal TSS controls the select driver 11 in known manner. The timing signal TSD controls the conversion circuit 121 of the data driver 12 to serially read in the video data of the video signal V and to supply the parallel video data DPj to the output stages 122 in known manner. The bias circuit 13 receives the timing signal TS to supply a bias control signal BCS to all output stages 122. Again, the bias control signal BCS may be the bias current IB. The timing signal TS may be generated with reference to the timing signal TSS (see FIG. 3A). Preferably, the timing signal TS should be active during the data setup time lasting from t1 to t2 in FIGS. 3A to 3F. The timing signals TS and TSS may be generated by decoding counts of a counter clocked by a clock signal being locked to the synchronization signal S accompanying the video signal V.

Figure 9:
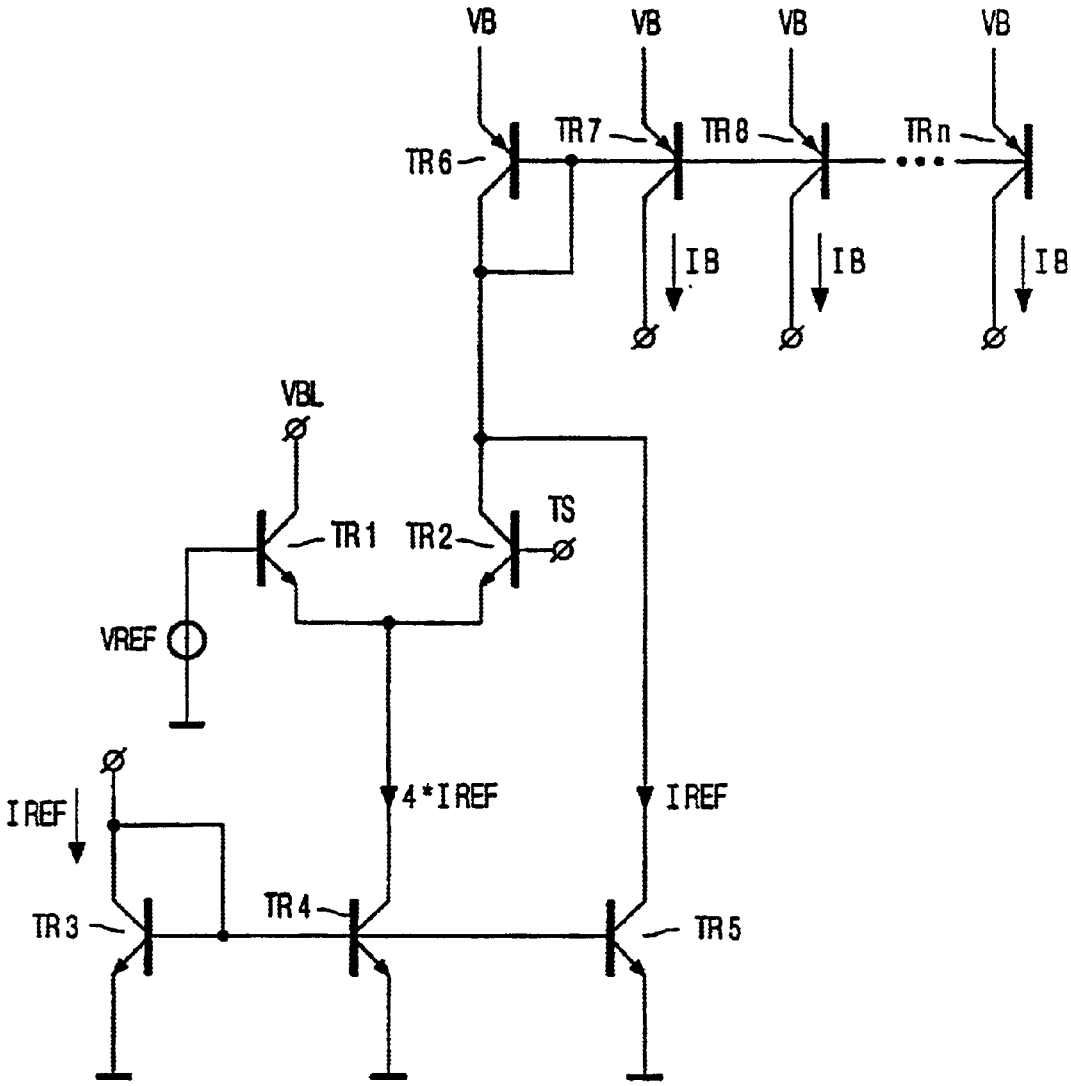
FIG. 9 shows a detailed embodiment of the bias control circuit of FIG. 8.

FIG. 9 shows a detailed embodiment of the bias control circuit of FIG. 8. In this situation, the bias circuit 13 does not comprise a detection circuit 131, but only a bias control circuit 132. The bias control circuit 132 of this embodiment of the bias circuit 13 is identical to the bias control circuit 132 as shown in FIG. 6. The same references denote the same components which operate in the same manner. The only differences are that the timing signal TS instead of the edge presence signal ED is supplied to the base of the transistor TR2, and that a bias current IB is supplied to each output stage 122. With respect to the last aspect, a plurality of pnp transistors TR8, . . . ,TRn is added. The base of each transistor TR8, . . . ,TRn is connected to the base of the transistor TR7. The emitter of each transistor TR8, . . . ,TRn is connected to the supply voltage VB, and the collector of each transistor TR8, . . . ,TRn is connected to the corresponding output stage 122. Consequently, when the timing signal TS has a low level, all output stages 122 covery a low bias current IB=IREF, and when the timing signal TS has a high level, all output stages 122 covery a high bias current IB=5*IREF.

The ratio between the high and the low bias currents IB depends on several factors, such as, for example, the construction of the output stages 122, and the data setup time. For an optimal performance of the data drivers 12, this ratio may thus be selected to be different from five.

It should be noted that the above-mentioned embodiments illustrate rather than limit the invention, and that those skilled in the art will be able to design many alternative embodiments without departing from the scope of the appended claims.

Although the invention has been elucidated with respect to a special construction of a PALC display as shown in FIG. 2, the invention can also be applied to other PALC displays. An example of an alternative PALC display wherein two adjacent plasma channels have one select electrode in common has been described in U.S. Pat. No. 5,661,501 which is herein incorporated by reference. Adjacent plasma channels need not be closed with respect to each other. The invention is also useful in data drivers of LCD panels, although the power dissipation will be decreased to a lesser extent due to the lower supply voltages involved.

It is possible to rotate the matrix display by 90° so that the data electrodes DEj extend horizontally.

Instead of the bipolar transistors in the embodiments of the invention as shown in FIGS. 6 and 9, field effect transistors may be used alternatively. It is also possible to detect whether a data edge occurs in the data signal DSj as supplied to the data electrode DEj instead of in the parallel data signals DPj.

In the claims, any reference signs placed between parentheses shall not be construed as limiting the claim. The word "comprising" does not exclude the presence of elements or steps other than those listed in a claim.

The invention can be implemented by means of hardware comprising several distinct elements, and as far as suitable, by means of a suitably programmed computer. In the device claim enumerating several means, several of these means may be embodied by one and the same item of hardware.

What is claimed is:

1. A driver circuit (1) for a matrix display panel (2) with select electrodes (SEi) and data electrodes (DEj), the driver circuit (1) comprising:

a select driver (11) for selecting the select electrodes (SEi), a data driver (12) for supplying data signals (DSj) to display elements (Pij) associated with a selected one of the select electrodes (SEi) via the data electrodes (DEj), characterized in that the driver circuit (1) further comprises bias circuitry (13) coupled to the data driver for increasing a bias current (IB) of the data driver (12) upon the occurrence of an edge of at least one of the data signals (DSj).

2. A driver circuit (1) for a matrix display panel (2) as claimed in claim 1, characterized in that the bias means (13) comprise detection means (131) for detecting whether a data edge occurs in a signal corresponding to one of the data signals (DSj), and a bias control means (132) for controlling the bias current (IB) of the data driver (12), said bias current (IB) being increased in response to the detected occurrence of the data edge.

3. A driver circuit (1) for a matrix display panel (2) as claimed in claim 2, characterized in that the data driver (12) comprises a plurality of output stages (122), each output stage (122) being coupled to a corresponding one of the data electrodes (DEj), and in that the bias control means (132) is coupled to all output stages (122) for controlling the bias current (IB) of each output stage (122).

4. A driver circuit (1) for a matrix display panel (2) as claimed in claim 1, characterized in that the data driver (12) comprises a plurality of output stages (122), each output stage (122) being coupled to a corresponding one of the data electrodes (DEj), the bias means (13) comprising a plurality of detection circuits (131), each detection circuit (131) being associated with a corresponding one of the data electrodes (DEj) for detecting whether a data edge occurs in a corresponding one of the data signals (DSj) so as to increase the bias current (IB) of a corresponding one of the output stages (122).

5. A driver circuit (1) for a matrix display panel (2) as claimed in claim 1, characterized in that the driver circuit (1) further comprises timing control means (14) for controlling instants at which the data driver (12) has to supply the data signals (DSj) to the display elements (Pij) associated with the selected one of the select electrodes (SEi), the timing control means (14) being coupled to the bias means (13) for indicating, in relation to said instants, periods in time when edges of the data signals (DSj) are expected to occur, the bias means (13) comprising bias control means (132) for controlling a value of the bias current (IB) to be lower outside at least part of said periods of time than a value of the bias current (IB) during at least part of said periods of time.

6. A display apparatus comprising a matrix display panel (2) with select electrodes (SEi) and data electrodes (DEj), and a driver circuit (1) comprising:

a select driver (11) for selecting the select electrodes (SEi), a data driver (12) for supplying data signals (DSj) to display elements (Pij) associated with a selected one of the select electrodes (SEi) via the data electrodes (DEj), characterized in that the driver circuit (1) further comprises bias circuitry (13) coupled to the data driver for increasing a bias current of the data driver (12) upon the occurrence of an edge of at least one of the data signals (DSj).

* * * * *